US006119287A

United States Patent [19]

Phillips

[11] Patent Number: 6,119,287

[45] Date of Patent: Sep. 19, 2000

[54] LIFT AND TRANSFER APPARATUS FOR A DISABLED PERSON

[76] Inventor: Barry S. Phillips, 8062 College Corner Rd., Centerville, Ind. 47330

[21] Appl. No.: 09/087,173

[22] Filed: May 29, 1998

[51] Int. Cl.[7] ..... A61G 7/14; A61G 7/12

[52] U.S. Cl. ..... 5/81.1 RP; 5/86.1; 5/89.1

[58] Field of Search ..... 5/86.1, 81.1 R, 5/83.1, 81.1 RP, 89.1; 297/344.23; 248/349.1

[56] References Cited

U.S. PATENT DOCUMENTS

| | | | |
|---|---|---|---|
| 3,165,314 | 1/1965 | Clearman et al. . | |
| 3,940,808 | 3/1976 | Petrini | 5/86.1 |
| 4,157,593 | 6/1979 | Kristensson | 5/86.1 |
| 4,168,633 | 9/1979 | Ciavattoni et al. | 297/344.23 |
| 4,435,863 | 3/1984 | Lerich | 5/81.1 |
| 5,507,044 | 4/1996 | Williamson et al. | 5/81.1 RP |
| 5,524,303 | 6/1996 | Palmer, Jr. et al. | 5/81.1 RP |

*Primary Examiner*—Alexander Grosz
*Attorney, Agent, or Firm*—Jacox, Meckstroth & Jenkins

[57] ABSTRACT

A disabled person transfer unit includes a base supporting a motor actuated rotatable platform, and a frame is mounted on the platform for pivotally supporting a pair of motor actuated lift arms which carry forearm support pads and hand grips and/or a removable seat sling. The arms pivot to pick up a person either seated or lying down, and the person may stand on the platform. The platform is rotated to transfer the person after which the arms lower the person to a new position. The base of the unit has retractable caster wheels for moving the unit and removable legs with outboard caster wheels for moving a person across the floor. A motor control box is movable to a position adjacent either of the hand grips.

14 Claims, 3 Drawing Sheets

LIFT AND TRANSFER APPARATUS FOR A DISABLED PERSON

BACKGROUND OF THE INVENTION

In the construction of devices or apparatus for transporting a patient or a handicapped or disabled person, for example, of the general type disclosed in U.S. Pat. No. 3,165,314, No. 3,940,808, No, 4,157,593 and No. 4,435,863, it is frequently desirable for the apparatus to be conveniently operated by the disabled person to minimize the need for another person or caregiver. The apparatus should also be effective for moving the person between a chair to another chair or between a chair and a bed and also between a chair and a commode. It is also desirable for the apparatus to be flexible in order to accommodate a disabled person having limited or no use of his legs and/or his arms. During the transfer, it is further desirable for the apparatus to be able to rotate the person at least 180° and preferably up to 360° whether seated or standing and, if possible, for the disabled person to be able to control the lifting and rotary movements in order to obtain a complete transfer without the aid of another person. It has also been found desirable for the base of the apparatus to sometimes be supported by swivel caster wheels for transporting a disabled person across a floor, and sometimes for the apparatus to be stationary and rest directly on the floor at a fixed location. As apparent, none of the devices disclosed in the above patents provide all of the above features.

SUMMARY OF THE INVENTION

The present invention is directed to an improved transfer unit or apparatus which provides all of the desirable features mentioned above and which is also collapsible into a compact space for storage or shipping. In general, the transfer apparatus of the invention includes a base of square metal tubing and having retractable caster wheels and removable legs and feet which also carry outboard caster wheels. The base supports a rotary circular platform which carries an upwardly projecting tubular metal frame for pivotally supporting a tubular metal arm member having a pair of horizontally spaced arms. The platform is rotated by a low voltage motor through a vertical shaft which extends downwardly through the platform to support a drive pulley. An endless flexible belt extends around the drive pulley and also around a non-rotating large diameter non-rotating pulley secured to the base.

Another low voltage motor drives a linear actuator which pivots the arm member for raising and lowering the arms. Each of the arms supports a removable forearm support pad and hand grip unit and also supports a removable fabric seat sling having adjustable straps connected to the arms. A removable body support bar and pad extend between the arms and also support adjustable straps extending from the seat sling, and both of the drive motors are controlled from a single push button control box which may be conveniently located adjacent either of the hand grips.

Other features and advantages of the invention will be apparent from the following description, the accompanying drawings and the appended claims.

DESCRIPTION OF THE PREFERRED EMBODIMENT

Figure 1:
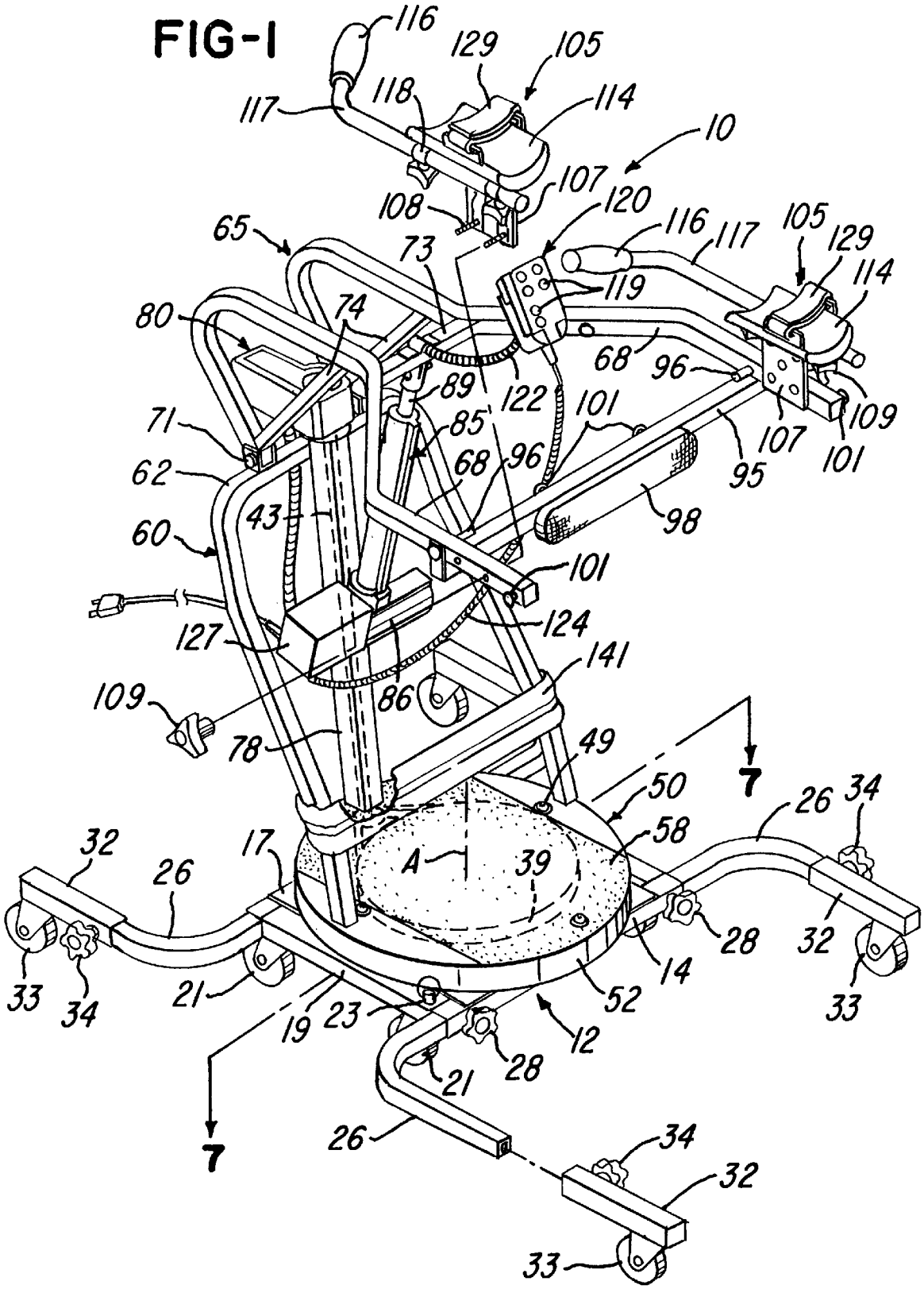
FIG. 1 is a perspective view of a disable person transfer unit or apparatus constructed in accordance with the invention and with a removable foot member and a removable arm support unit shown in exploded positions.
Figure 2:
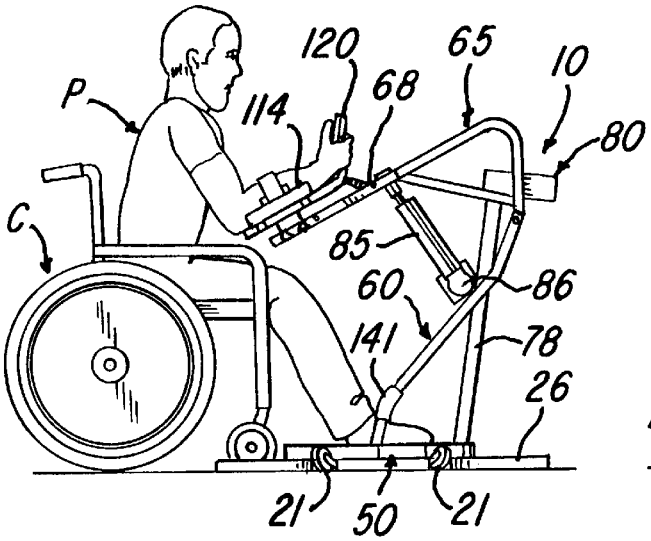
FIGS. 2 and 3 are side elevation views of the apparatus seated on the floor and illustrating the lifting of a handicapped person from a wheelchair to a standing position on the apparatus platform.
Figure 7:
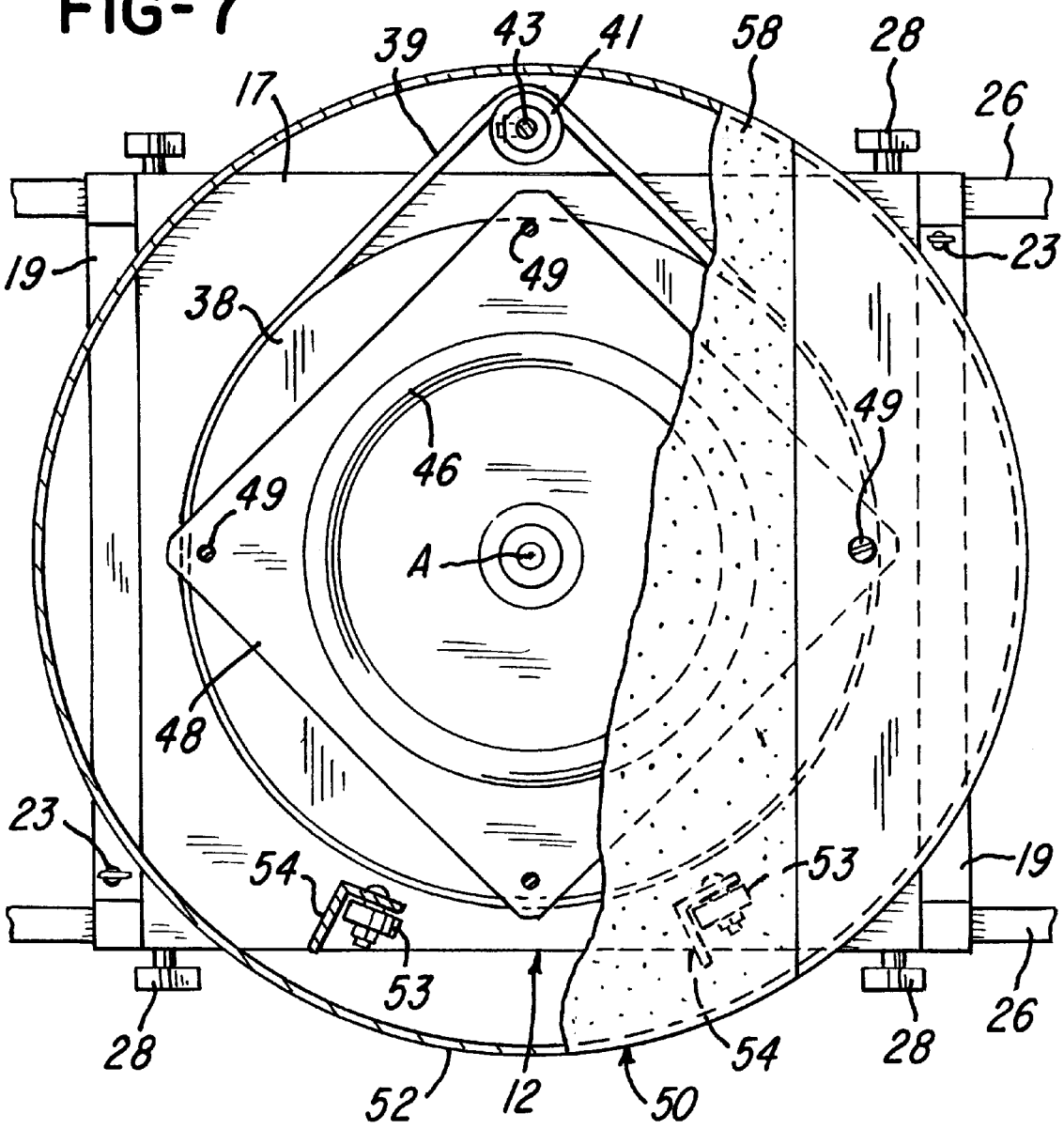
FIG. 7 is a fragmentary section taken generally on the line of 7—7 of FIG. 1 and showing the support and drive system for the platform.

FIG. 1 illustrates an apparatus or mobile unit 10 for lifting and transferring a disabled person P (FIG. 2) and which includes a base 12 having a pair of parallel spaced square tubular base members 14 rigidly connected by a welded top plate 17 (FIG. 7). A pair of cross tubes 19 (FIG. 1) are pivotally connected to the tube members 14, and each tube 19 carries a pair of swivel or caster wheels 21. The assembly of each tube 19 and pair of wheels is rotatable on its longitudinal axis between a downwardly projecting position (FIG. 1) and a retracted position (FIGS. 2–5) so that the base frame 12 may be supported for movement by the wheels 21 or may rest directly on the floor as shown in FIGS. 2–5. In each position, each tube 19 is locked in position by a retractable detent pin 23. When the pin is retracted, the corresponding tube 19 and caster wheels 21 may be pivoted 90° between their retracted and active positions. The base 12 also includes a set of four removable L-shaped leg members 26 which are also made of square tubular metal. One end portion of each leg 26 is received within a base tube 14 and is releasably retained by a rotatable knob screw 28. The opposite end of each leg 26 is adapted to receive a removable foot 32 having a caster wheel 33. Each foot 32 is releasably retained on the corresponding leg 26 by a rotatable knob screw 34.

Referring to FIG. 7, a V-belt pulley 38 is rigidly secured to the plate 17, and a flexible drive member or V-belt 39 extends around the pulley 38 and also around a drive pulley 41 secured to the lower end portion of a vertical shaft 43. A large diameter anti-friction bearing 46 includes a bottom plate (not shown) secured to the pulley 38 and a top plate 48 secured by four corner screws 49 to a circular metal platform 50 having a depending peripheral skirt 52 which surrounds the pulley 38. The bearing 46 supports the platform 50 for rotation on a vertical axis A, and a front portion of the platform 50 is also supported by a pair of angularly spaced bearings or rollers 53 mounted on angle brackets 54 welded to the underneath surface of the rotatable platform 50. The top surface of the platform carries a sheet or pad 58 of non-slip material and forms a friction surface for receiving a person's feet.

An inverted U-shaped frame 60 (FIG. 1) is formed of square metal tubing, and the lower ends of the frame 60 are welded or secured to the platform 50 so that the frame 60 rotates with the platform. The frame 60 includes a horizontal offset cross member 62 which pivotally supports a fabricated arm member 65 also formed of square metal tubing. The arm member 65 includes a pair of formed tubular metal arms 68 which have rearward end portions pivotally connected to the cross member 62 by U-shaped brackets and pivot pins 71. The arms 68 are rigidly connected by a cross bar or member 73 welded to the arms, and inclined brace members 74 are also welded to the arms for reinforcement.

A square tubular metal post 78 has a lower end secured or welded to the platform 50, and the upper end of the post supports a motor and gear reducer unit 80 which includes a 24 volt reversible DC motor. The drive unit 80 drives the upper end portion of the shaft 43 which extends vertically within the center of the post 78. As apparent from FIG. 7, when the shaft 43 and pulley 41 are rotated in either direction, the drive pulley 41 orbits around the stationary pulley 38, thereby rotating the platform 50, the frame 60 and arm member 65 in a clockwise or counter-clockwise direction on the vertical axis A.

Figure 3:
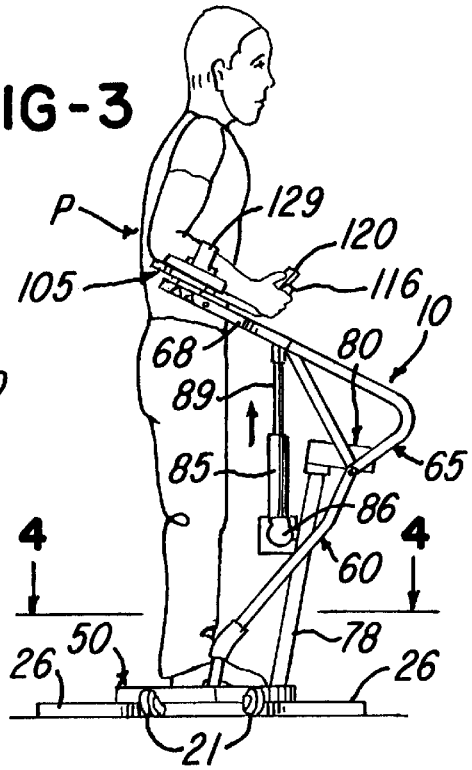
Figure 4:
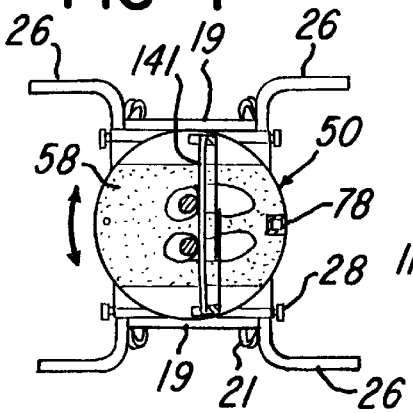
FIG. 4 is a view taken generally on the line 4-4 and illustrating the platform and person before rotation.
Figure 5:
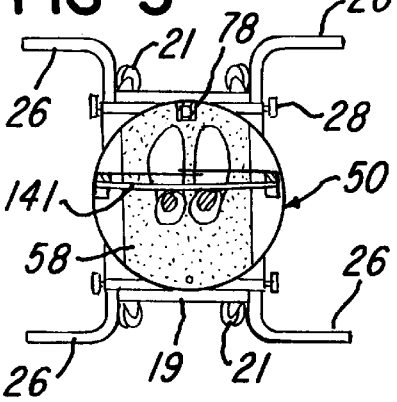
FIG. 5 is a view similar to FIG. 4 and illustrating the platform and person rotated 90° from the position shown in FIGS. 3 and 4.

A motor driven screw jack or linear actuator 85 has a lower portion including a 24 volt DC motor 86 and is pivotally connected to the post 78. The actuator 85 also includes an extendable screw or rod 89 which is pivotally connected to the cross member 73 of the arm member 65. Thus when the motor 86 is actuated in opposite directions, the actuator 85 pivots the arm member 65 between a lower retracted position (FIG. 2) and an upper extended position (FIG. 3).

The forward parallel spaced end portions of the arms 68 carry a removable cross bar or member 95 having opposite end portions which are removably secured to the arms 68 by retractable detent pins 96. The cross bar or member 95 also carries an elongated body pad 98 and also has a pair of button-head studs 101 welded or secured to the rear surface of the cross bar 95. Another pair of button-head studs 101 are secured or welded to the forward end portions of the arms 68 and project laterally outwardly from the arms.

A pair of arm support units 105 (FIG. 1) include corresponding brackets 107 which are removably secured to the forward end portions of the arms 68 by a set of screws 108 and rotatable knob nuts 109. Each of the units 105 includes a forearm support pad 114 secured to the corresponding bracket 107, and an adjustable hand grip 116 and hand grip tube or bar 117 are adjustably connected to each bracket 107 by a pair of band clamps 118. When the clamps 118 are released, the hand grip bars 117 may be rotated and adjusted axially relative to the corresponding forearm support pad 114 for precisely positioning the hand grips for the disabled person.

The motor driven actuators 80 and 85 are independently controlled by driving the corresponding motors and in opposite directions by a set of push buttons 119 on a control box 120. The box 120 is supported by a flexible conduit 122 having a rearward end portion secured to the cross member 73 of the arm assembly or member 65. The conduit 122 encloses one set of electrical conductors which extend to the motor of the actuator 80, and a flexible coil 124 of electrical conductors extend from the control box 120 to a 24 volt DC converter 127 for the reversible motor 86 of the actuator 85. The flexible conduit 122 permits the control box 120 to be positioned adjacent either of the handle grips 116 of the arm support units 105 so that a disabled person's thumb or fingers may be used to control the pivotal movement of the arm member 65 on the horizontal axis of the pivot pins 71 and the rotation of the platform 50 and the arm member 65 on the vertical axis A of the platform 50.

As illustrated in FIGS. 2–5, the lift and transfer unit or apparatus of the invention may be used for assisting a disabled person P into and out of a wheelchair C. For example, after the wheelchair is rolled up to the apparatus 10, the person's forearms may be placed on the forearm support pads 114 and secured by the Velcro straps 129. While the person's hands are gripping the hand grips 116, the person's thumb may be used to depress the button on the control box 120 for raising the arms 68 until the person is standing vertically on the center of the platform 50 (FIG. 3). During this lifting operation, the cross bar 95 and body pad 98 are removed so that the person's body may stand directly in the center of the platform 50. After the person is standing, he may operate the actuator 80 to rotate the platform and the arm member 65 in either direction and through any angle such as 90° or 180° or 270° since the platform may be rotated a full 360°. After rotation, the person may reverse the actuator 85 to lower the arm member 65 so that the person is reseated on a chair or bed or a commode.

Figure 6:
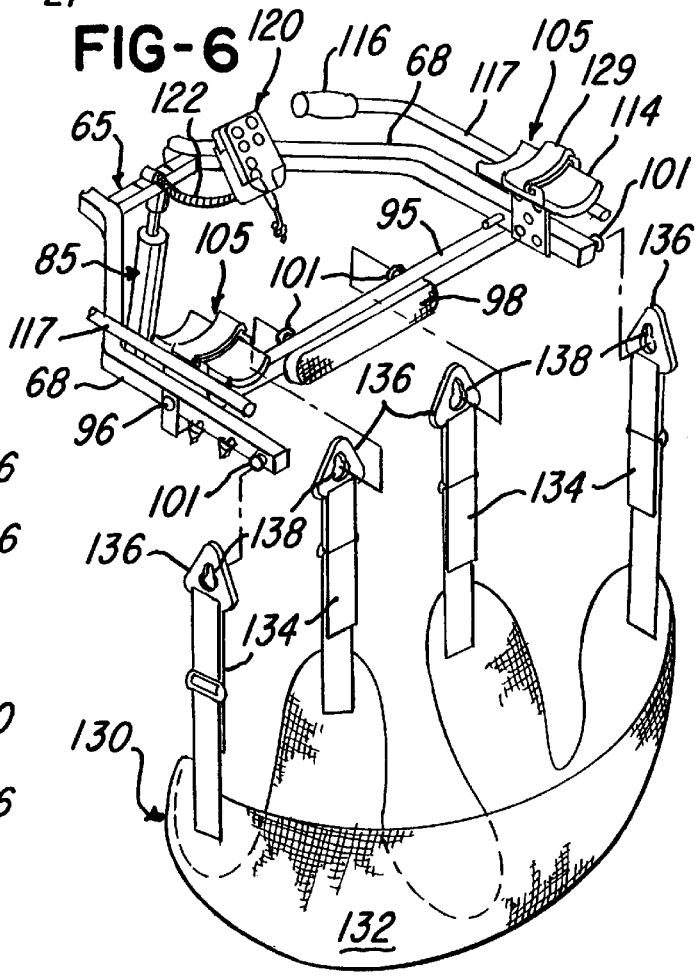
FIG. 6 is a fragmentary perspective view of the pivotal arm member shown in FIG. 1 and illustrating the attachment of a flexible seat sling in accordance with the invention.

Referring to FIG. 6, when a disabled person is unable to support himself in a standing position and/or does not have the strength in his arms to use the arm support units 105, the apparatus 10 includes a seat sling 130. The sling 130 includes a fabric seat member 132 and a set of four adjustable straps 134 each of which extends through a slot within a metal connector plate 136 having a keyhole-shaped opening 138. After the seat sling is positioned under the bottom of the person, the plates 136 are attached to the button head studs 101 on the forward end portions of the arms 68 and also to the studs 101 on the rear of the cross bar 95, as illustrated in FIG. 6. When the actuator 85 is fully retracted, the arm member 65 and the seat sling 30 may be used to pick up a horizontal person lying on the floor in front of the apparatus 10 with the person's legs straddling the apparatus. The seat sling 130 may also be used to transfer a person, for example, between a bed and a wheelchair. When a person is standing on the platform 50 or is supported by the seat sling 130, a flexible and soft leg pad 141 (FIG. 1) attached to the frame 60, helps position the person's legs relative to the platform 50.

From the drawings in the above description, it is apparent that a lift and transfer apparatus constructed in accordance with the invention, provides desirable features and advantages. For example, the apparatus may not only be used for lifting a disabled person by means of the arm support units 105 and/or the sling seat 130, but may also be used to transfer the person to another chair or seat by rotation of the platform 50 which carries all of the components above the platform. Furthermore, with the outward set of caster wheels 33 on the attached feet 32, the apparatus and the disabled person may be transported across a floor with the aid of a caregiver so that the person may be delivered to another location. With the legs 26 and feet 32 removed or with the legs 26 or feet 32 rotated 90°, only the caster wheels 21 are used to move the apparatus by itself from one location to another location. Furthermore, with the caster wheels 21 retracted and the feet 32 removed or rotated 90°, the apparatus may be supported directly on the floor at a stationary location, as shown in FIGS. 2–5.

It is also apparent that the apparatus may be used as an exerciser for a disabled person who is able to grip the arm support units 105 and operate the actuator 85 to assist in moving the person between a seated position and a standing position. As also described above, a person may be rotated to a new position with the platform 50 while the person is either standing on the platform or is supported by the seat sling 130. Moreover, with the arm member 65 fully retracted and the legs 26 and feet 32 removed and positioned on the platform 50, the apparatus occupies a compact space which is desirable for storage, shipping or moving on the caster wheels 21.

While the form of apparatus herein described constitutes a preferred embodiment of the invention, it is to be understood that the invention is not limited to this precise form of apparatus, and that changes may be made therein without departing from the scope and spirit of the invention as defined in the appended claims.

What is claimed is:

1. Apparatus for transferring a disabled person and operable by the disabled person, comprising a base supporting a platform for rotary movement on a generally vertical axis and adapted to support the person, frame mounted on said platform for rotation therewith and projecting upwardly from said platform, an arm member supported by said frame for pivotal movement on a generally horizontal axis, a person lift member connected to said arm member for movement therewith and adapted to raise and lower the disabled person in response to pivoting of said arm member, a first reversible electric motor driven actuator carried by said platform and connected to pivot said arm member relative to said frame and said platform for lifting the disabled person with said person lift member, a second reversible electric motor driven actuator connected to rotate said platform through a substantial angle for rotating said arm member and said person lift member and the disabled person about said vertical axis, an electrical control system connected to control said first and second motor driven actuators, and means positioning said control system for operation by a hand of the disabled person being lifted by said person lift member.

2. Apparatus as defined in claim 1 wherein said second actuator comprises a reversible electric motor and reducer unit connected to rotate a drive shaft connected to rotate said platform.

3. Apparatus as defined in claim 2 and including a non-rotatable wheel mounted on said base, a drive wheel mounted on said drive shaft, and a flexible drive member extending around said wheels for rotating said platform by revolving said drive wheel with said flexible drive member around said non-rotatable wheel.

4. Apparatus as defined in claim 1 wherein said arm member comprises a pair of horizontally spaced arms, and a forearm support pad and hand grip mounted on each of said arms.

5. Apparatus as defined in claim 4 wherein each of said forearm support pads and corresponding hand grip are connected to form a unit, means for releasably connecting each of said units to the corresponding said arm, and means for adjusting each said hand grip relative to the corresponding support pad.

6. Apparatus as defined in claim 1 wherein said arm member comprises a pair of horizontally spaced arms, and said person lift member includes a flexible sling seat having adjustable straps releasably connected to said arms.

7. Apparatus as defined in claim 6 and including an elongated generally horizontal body support bar extending between said arms and having opposite end portions releasably connected to said arms, and said sling seat has adjustable straps releasably connected to said support bar.

8. Apparatus as defined in claim 1 and including a set of caster wheels connected to said base for movement between downwardly projecting active positions and retracted inactive positions.

9. Apparatus as defined in claim 1 wherein said base includes a plurality of horizontally spaced and outwardly projecting horizontally adjustable leg members, and a foot member removably connected to each of said leg members and including a caster wheel.

10. Apparatus as defined in claim 1 and including a resilient leg support member attached to said frame and spaced between said platform and said arm member for engaging the person's legs.

11. Apparatus as defined in claim 1 wherein said first actuator comprises a screw jack having a reversible electric motor, and means pivotally connecting said screw jack to said arm member and to said platform.

12. Apparatus as defined in claim 1 and including a flexible conduit supported by said arm member and supporting said control system.

13. Apparatus as defined in claim 1 wherein said base includes a plurality of outwardly projecting and removable L-shaped leg members, and a foot member removably connected to each of said leg members and including a caster wheel.

14. Apparatus as defined in claim 13 wherein said base, frame, arm members and leg members each comprises square metal tubing.

* * * * *